US006279499B1

(12) United States Patent
Griffith, Sr. et al.

(10) Patent No.: US 6,279,499 B1
(45) Date of Patent: Aug. 28, 2001

(54) ROTATIONAL JET-DRIVE BOW THRUSTER FOR A MARINE PROPULSION SYSTEM

(75) Inventors: Thomas E. Griffith, Sr., Florence, MS (US); Harold L. Wikel, Muskego, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/540,814

(22) Filed: Mar. 31, 2000

(51) Int. Cl.[7] ..... B63H 25/46

(52) U.S. Cl. ..... 114/151; 440/38

(58) Field of Search ..... 114/151; 440/38, 440/40, 42

(56) References Cited

U.S. PATENT DOCUMENTS

| | | | | |
|---|---|---|---|---|
| 3,468,276 | * | 9/1969 | Pollard et al. | 114/151 |
| 3,802,376 | * | 4/1974 | Smith | 440/42 |
| 4,034,696 | * | 7/1977 | Kureth | 440/42 |

* cited by examiner

*Primary Examiner*—Jesus D. Sotelo
(74) *Attorney, Agent, or Firm*—Fletcher, Yoder & Van Someren

(57) ABSTRACT

A propulsion system for a watercraft is provided, which may be an integral part of a watercraft or may be retrofitted to a particular watercraft. The propulsion system is fixedly mounted to the hull in a central area, rather than along the perimeter of the watercraft. The propulsion system includes a jet-drive assembly coupled to a jet, an angular drive assembly for rotating the jet, and a control system for controlling the jet-drive assembly and the angular drive assembly.

34 Claims, 6 Drawing Sheets

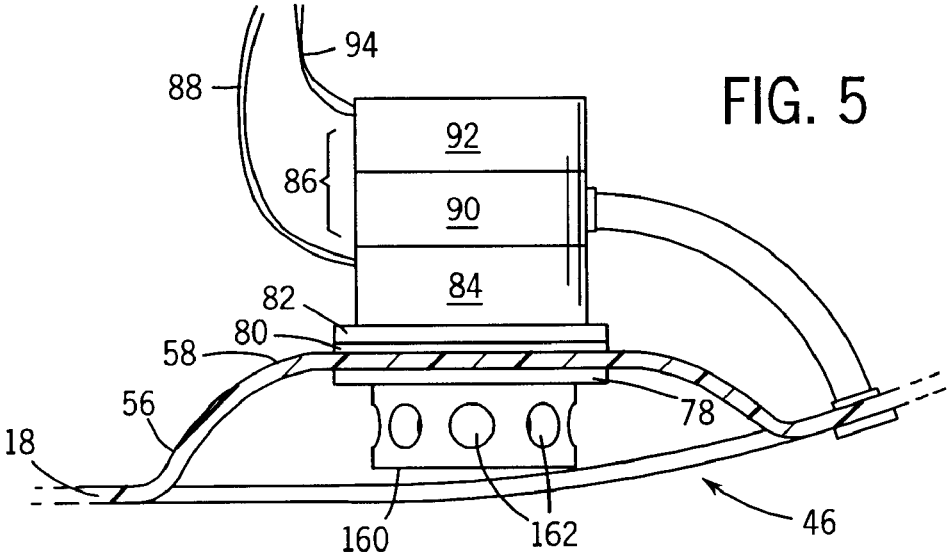
FIG. 5
FIG. 6
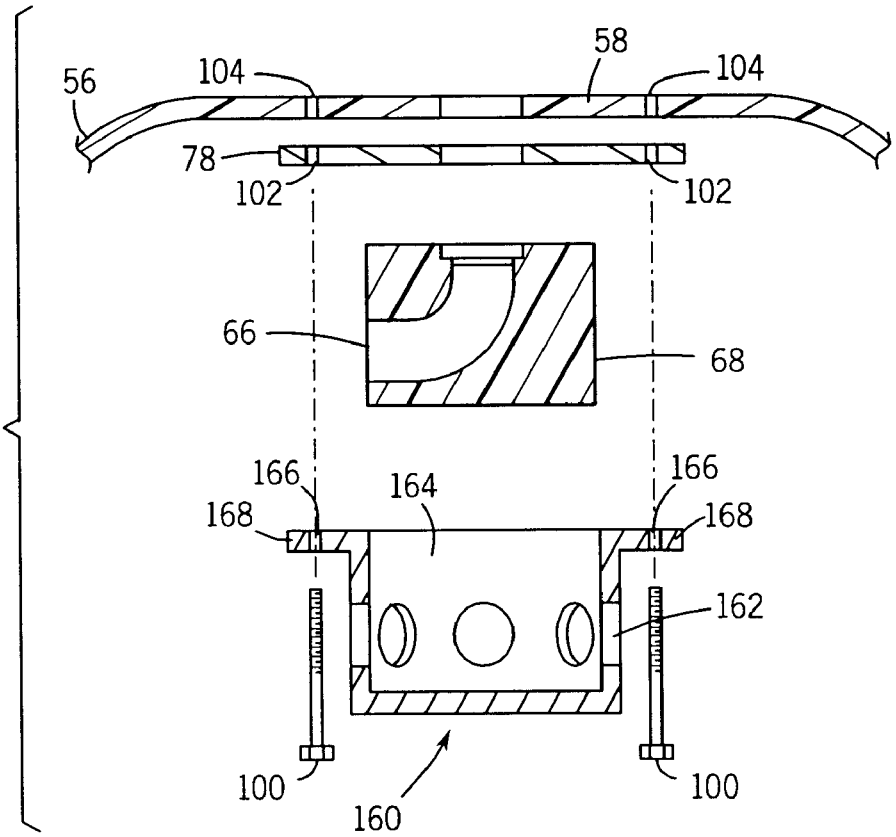

ROTATIONAL JET-DRIVE BOW THRUSTER FOR A MARINE PROPULSION SYSTEM

BACKGROUND OF THE INVENTION

1. Field of the Invention

The present invention relates generally to electric propulsion units for recreational watercraft. More specifically, the present invention relates to propulsion units that mount in a forward area of the watercraft.

2. Description of the Related Art

Recreational watercraft are typically used for various activities such as fishing, cruising, water skiing, kneeboarding, tubing and like sports. To move the watercraft across the water, an adequate amount of thrust is necessary depending on the particular activity. The thrust may be provided by various types of propulsion systems, both engine-driven and electric-motor driven. Electrical and mechanical propulsion systems generally include outboard and inboard engine driven propeller systems.

Internal combustion engine drives are generally disposed at the rear of a watercraft at a transom, either outboard or inboard. Outboard motors are typically secured to the transom of a boat, while inboard motors have a propeller extending through the transom from an internal combustion engine disposed within a housing of the hull. Both outboard and inboard motors are particularly useful for high-speed and highly responsive navigation of the watercraft. Drawbacks of such drives, however, include their noise levels, exhaust emissions, relative complexity, size and weight.

Electric propulsion systems for pleasure craft are typically referred to as trolling motors or electric outboards. These systems include an electric motor that can be rotated at various speeds to drive a prop. The prop produces a thrust, which is directed by proper orientation of the propulsion unit. In conventional trolling motors, for example, a control head may be manually oriented to navigate the boat in a desired direction, or a remote control assembly may be provided for rotating a support tube which holds the propulsion unit submerged during use. While certain relatively minor differences may exist, the term electric outboard is typically employed for the conventional trolling motor design, but with a horsepower range elevated with respect to the conventional trolling motor, such as in excess of 1 horsepower.

While the conventional trolling motor provides quiet and reliable navigation, extremely useful for certain activities such as fishing, there is considerable room for improvement. For example, conventional trolling motors are typically after-market, add-on units designed for mounting on the deck of a watercraft. Such units are typically supported by a mounting structure, a wide range of which may be obtained commercially. These structures allow for relatively straightforward deployment of the motor to position the propulsion unit below the waterline alongside the watercraft, and retraction of the unit for stowage on the deck. The entire motor and mount, however, generally remain securely fixed to the deck, both during use and when stowed. The resulting structure is somewhat cumbersome and occupies useful space on the deck, limiting access to the water in the area of the motor mount. Moreover, while much energy and creativity have been invested in boat designs, the aesthetics and aerodynamics of the hull may be somewhat impaired by the trolling motor and mount positioned on the deck, typically adjacent to the bow. Furthermore, conventional trolling motors only provide thrust at a point around the perimeter of a watercraft, thereby allowing external forces such as wind to force the watercraft out of alignment with the desired direction of movement across the water.

SUMMARY OF THE INVENTION

The present invention provides a propulsion system for a watercraft designed to address these drawbacks. The propulsion system may be an integral part of a watercraft or may be retrofitted to a particular watercraft. In a preferred embodiment, the propulsion system is fixedly mounted to the hull in a central area, rather than along the perimeter of the watercraft. This frees up deck space, and avoids the problems associated with a trolling motor mounted to the deck. The propulsion system may be used to provide a primary thrust, an alternative thrust, a correctional steering thrust, or it may be used for a variety of other applications.

The propulsion system preferably includes a jet coupled to a jet-drive assembly, an angular drive assembly for rotating the jet to a desired angle of thrust, and a control system coupled to the jet-drive assembly and the angular drive assembly. The propulsion system may also include a recessional housing for streamlining the propulsion assembly into the hull of the watercraft. The recessional housing may be an integral part of the watercraft, or it may be retrofitted to a particular watercraft.

In operation, the propulsion system may be used with or without a rear motor, such as an inboard or outboard motor. If a rear motor is present, the angular drive assembly may rotate the jet to an angle of thrust necessary to account for external forces such as wind or water currents, or it may be used to dock the watercraft. If the propulsion assembly is used as a primary propulsion device, then the central location may be very advantageous in improving the steering and control of the watercraft.

BRIEF DESCRIPTION OF THE DRAWINGS

The foregoing and other advantages of the invention will become apparent upon reading the following detailed description and upon reference to the drawings in which:

FIG. 5 is a side view of an alternate embodiment of the propulsion assembly disposed about the mounting area, wherein the propulsion assembly has a stationary housing disposed about the jet;

FIG. 6 is a cross-sectional side view of an alternate embodiment of the propulsion assembly, wherein the stationary housing is disposed about the disk-shaped head;

DETAILED DESCRIPTION OF SPECIFIC EMBODIMENTS

Figure 1:
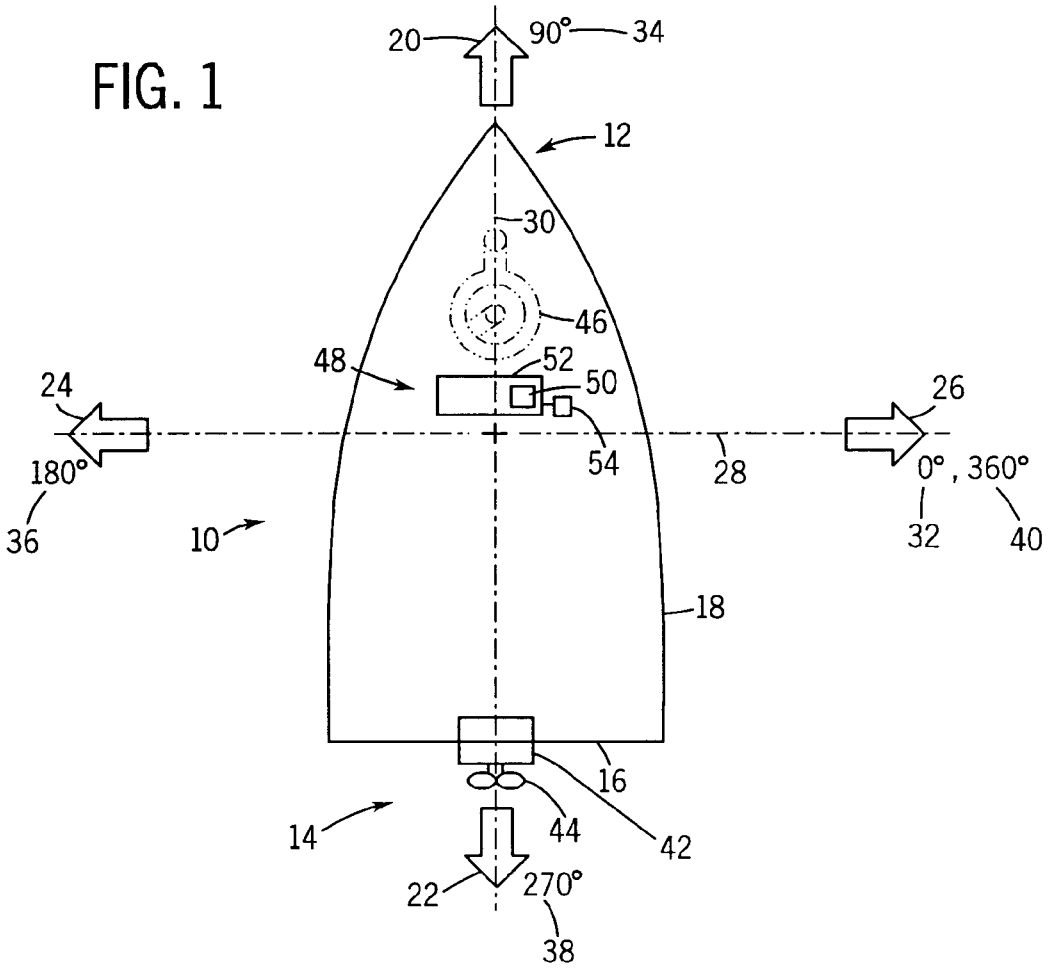
FIG. 1 is a top view of an embodiment of a propulsion system in accordance with the present technique disposed in a watercraft.

Turning now to the drawings and referring first to FIG. 1, the present invention is configured for mounting in a watercraft 10 having a bow 12, a stern 14, a transom 16 at the stern 14, a hull 18. For navigational reference, FIG. 1 indicates a forward direction 20, a reverse direction 22, a left direction 24, a right direction 26, a transverse centerline 28, a longitudinal centerline 30, and angles of 0°, 90°, 180°, 270°, and 360°, as indicated by reference numerals 32, 34, 36, 38, and 40, respectively. The watercraft may also have a rear drive 42, mounted either inboard or outboard as illustrated in FIG. 1. The rear drive 42, which may be a conventional outboard motor, for example, has a prop 44 for displacing water to propel the watercraft 10. The invention provides a propulsion assembly 46 mounted to the hull 18, such as in a position forward of the transverse centerline 28, preferably along the longitudinal centerline 30. The propulsion assembly 46 is controlled by a control system 48, which may include instruments 50 disposed on a console 52, and a foot pedal 54 for hands-free control of the propulsion assembly 46. As will be appreciated by those skilled in the art, foot pedal 54 may be replaced or complemented by other operator input devices, such as a joy stick, steering wheel, or console switches. As described below, propulsion assembly 46 permits navigation in any direction 20, 22, 24 or 26, or at various angles between these directions.

Figure 2:
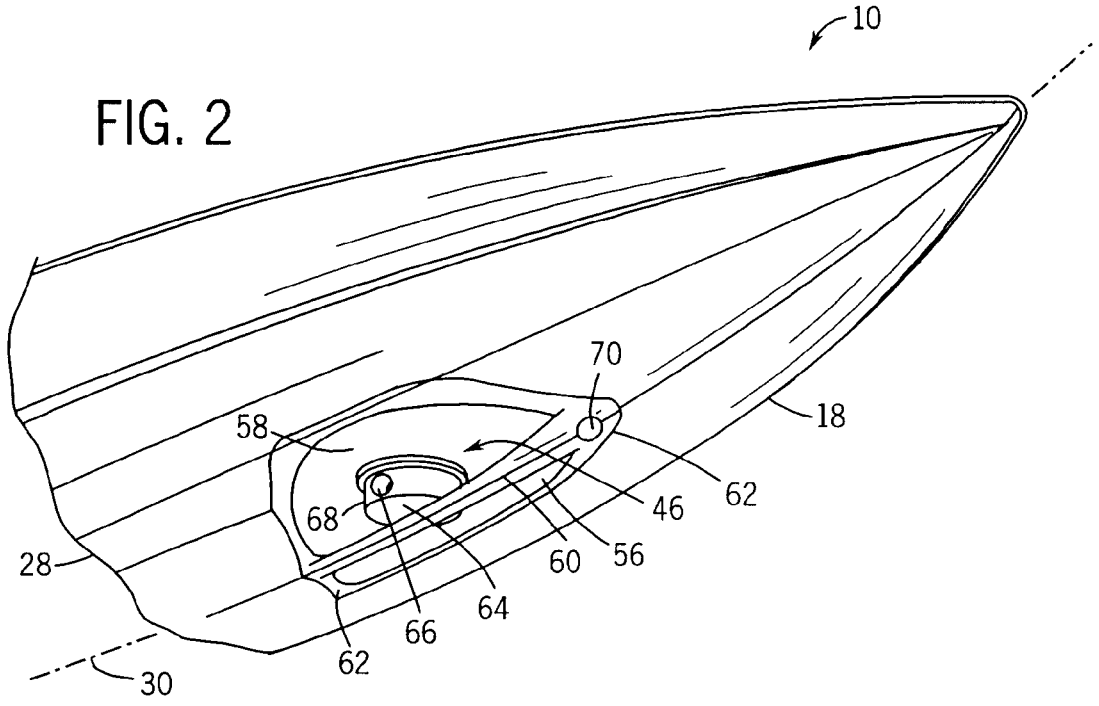
FIG. 2 is a bottom perspective view of an embodiment of a propulsion assembly disposed in a recessional housing of a hull of the watercraft.

FIG. 2 illustrates a bottom perspective view of the watercraft 10 having the propulsion assembly 46 mounted in a recessional housing 56, which is sealingly coupled to the hull 18, typically forward of the transverse centerline 28. The recessional housing 56 extends inwardly into the hull 18, preferably to a mounting area 58 configured for the propulsion assembly 46. A support 60 may extend across the recessional housing 56 and over the propulsion assembly 46 in the illustrated embodiment. When provided, the support 60 is preferably streamlined with the hull 18. However, the recessional housing 56 may be designed without a support 60, or with an alternate orientation or design. For example, the support 60 may be a panel that totally covers the recessional housing 56, except for a circular pattern of holes aligned with the propulsion assembly 46. Alternatively, the recessional housing 56 may be eliminated, such as when the propulsion assembly 46 is otherwise properly supported and water drag is either insignificant or addressed by other means, such as a fin.

The recessional housing 56 may be manufactured separately from, or together with, the hull 18. The recessional housing 56 is preferably manufactured from fiberglass, but may be made from metal such as aluminum, or a variety of other materials, such as moldable plastics, depending on the application. If manufactured separately from the hull 18, the recessional housing 56 preferably has a reinforced area 62 extending around the recessional housing 56 to ensure a strong watertight mounting to the hull 18. Furthermore, the recessional housing 56 preferably mounts along the longitudinal centerline 30 (see FIG. 1) to provide a more symmetric and balanced control of the watercraft 10. However, if a plurality of propulsion assemblies 46 are mounted to the watercraft 10, or if other considerations require, the propulsion assembly 46 may be mounted at other locations on the hull 18.

The propulsion assembly 46 preferably includes a rotatable body 64 having a jet 66 to provide a stream of water for thrust in a desired direction. A preferred embodiment of the rotatable body 64 has a disk-shaped head 68, and the jet 66 disposed therein. The disk-shaped head 68 is preferably manufactured from a suitable plastic material, although a variety of metals or suitable materials may be used. The propulsion assembly 46 intakes water from an opening 70, which may be disposed through the recessional housing 56, as illustrated in FIG. 2, or elsewhere through the hull 18.

Figure 3:
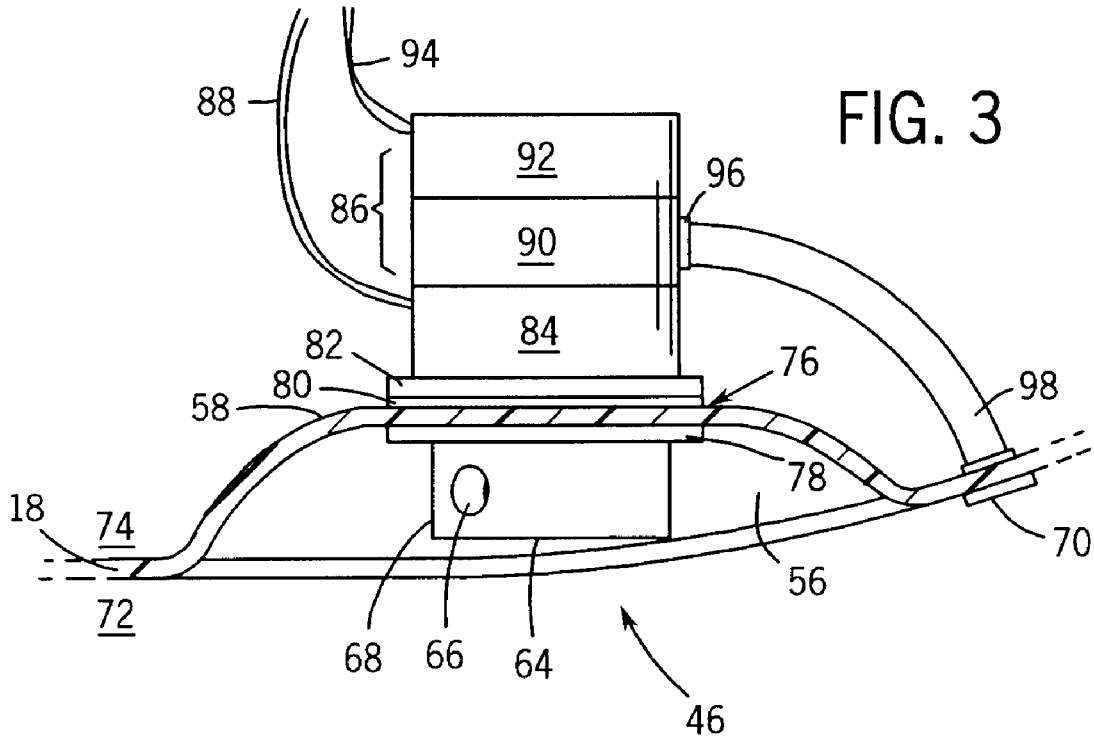
FIG. 3 is a side view of an embodiment of the propulsion assembly disposed about a mounting area of the recessional housing.

FIG. 3 illustrates a side view of an embodiment of the propulsion assembly 46 disposed at the mounting area 58, wherein the hull 18 and the recessional housing 56 are illustrated as cross-sections along the longitudinal centerline of the watercraft 10. As illustrated, the preferred embodiment of the present invention has the propulsion assembly 46 mounted symmetrically about the mounting area 58. A part of the propulsion assembly 46 is mounted outboard, as indicated by reference numeral 72, while part of the propulsion assembly 46 is mounted inboard, as indicated at numeral 74.

The propulsion assembly 46 preferably includes a support and seal assembly 76, which may include a first plate 78, a seal 80 and a second plate 82. The first plate 78 is disposed outboard between the disk-shaped head 68 and the mounting area 58. The seal 80 is preferably disposed inboard at the mounting area 58. The second plate 82 is disposed adjacent the seal 80. The seal 80 is preferably made of a pliant rubber, but any suitable sealing material may be used. The first and second plates 78 and 82 are preferably made of metal, for example, aluminum or stainless steel. In the embodiment of FIG. 3, the propulsion assembly 46 further includes an angular drive assembly 84 and a jet-drive assembly 86, which are mounted inboard opposite to the disk-shaped head 68.

The angular drive assembly 84 preferably has an electric drive motor, capable of forward and reverse operation, which is coupled to the control system 48 (see FIG. 1) through a wiring assembly 88. The angular drive assembly 84 is coupled to the rotatable body 64, providing angular steering control of the jet 66. In one embodiment, the rotatable body 64 may include only the disk-shaped head 68. Accordingly, the angular drive assembly 84 could rotate the disk-shaped head 68, while the angular drive assembly 84 would remain fixed at the mounting area 58. Alternatively, the rotatable body 64 may include the angular drive assembly 84 and/or the jet-drive assembly 86, and move the entire group of components. In this alternate embodiment, the angular drive assembly 84 may have gears, rollers or other means to drive itself, and the entire rotatable body 64, along and about the second plate 82. Alternatively, the angular drive assembly 84 may employ other mechanical, or manual, means for rotating the rotatable body 64. For example, a pulley-system and/or a steering wheel may be used to turn the rotatable body.

The jet-drive assembly 86 preferably includes a pump 90 drivingly coupled to a drive unit 92, which is coupled to the control system 48 through a wiring assembly 94. One embodiment of the pump 90 has an inlet 96 coupled to a conduit 98, which is coupled to the opening 70. In operation, water enters through the opening 70, and the pump 90 draws the water through the conduit 98 and expels the water through the jet 66. The conduit 98 may be a flexible tube, or a rigid tube such as an ABS or PVC pipe. Preferably, the pump 90 is a rotary pump and the drive unit 92 includes an electric motor.

The jet-drive assembly 86 preferably has a symmetric or rotary configuration, as illustrated. However, the desired configuration of the jet-drive assembly 86 may vary depending on the size of the watercraft 10, the available space, and the type of angular drive assembly 84 employed therein, as discussed above. For example, if the angular drive assembly 84 rotates the jet-drive assembly 86, then a symmetric or rotary-style system may be desirable. If the jet-drive assembly 86 remains fixed, then a variety of other configurations for the jet-drive assembly 86 may be desirable.

Figure 4:
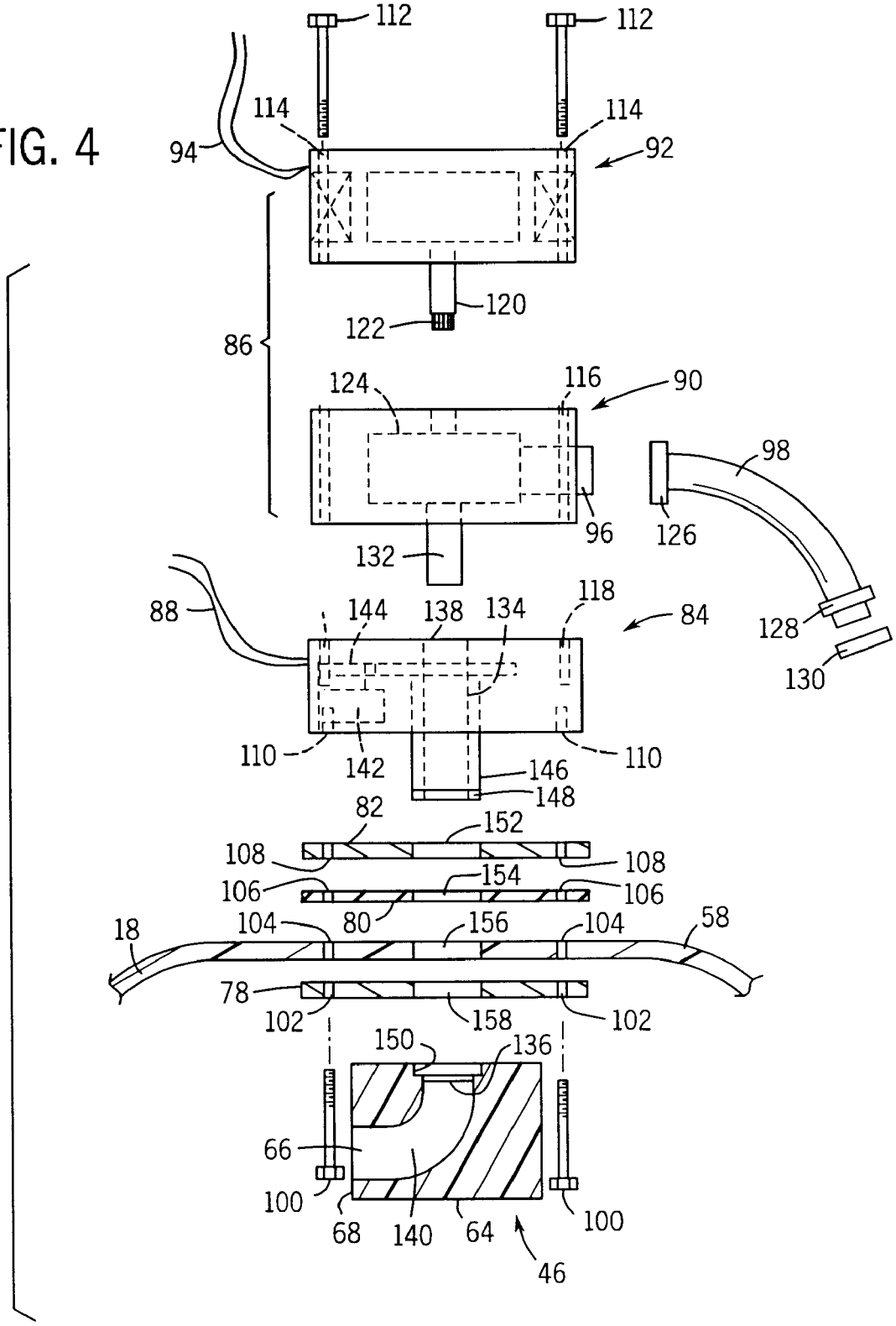
FIG. 4 is an exploded side view of an embodiment of the propulsion assembly having a disk-shaped head with a jet disposed therein.

FIG. 4 illustrates an exploded view of the propulsion assembly 46. In this embodiment, the disk-shaped head 68 is rotatable by the angular drive assembly 84, which remains fixed along with the jet-drive assembly 86. The angular drive assembly 84 is secured to the mounting area 58 via fasteners, such as bolts 100. The bolts 100 are disposed through holes 102, 104, 106, 108 and 110, which extend through the first plate 78, the mounting area 58, the seal 80, the second plate 82 and into the angular drive assembly 84, respectively. Threads are provided in the holes 110 for securing the bolts 100. Additionally, threads may be provided in the holes 102, 104 and/or 108. The jet-drive assembly 86 is coupled to the angular drive assembly 84 via fasteners, such as bolts 112. The bolts 112 are disposed through holes 114, 116 and 118, which extend through the drive unit 92, the pump 90 and into the angular drive assembly 84, respectively. Threads are preferably provided in the holes 118 for securing the bolts 112. Additionally, threads may be provided in the holes 114 and/or 116.

The jet-drive assembly 86 may be a single unit or it may have separate components, commercially available or specially designed, depending upon the application-specific design parameters. In this embodiment, the jet-drive assembly 86 includes the drive unit 92 coupled to the pump 90. The drive unit 92 includes a drive shaft 120 having a male end 122, which is configured to engage and drive an internal assembly 124 of the pump 90.

The pump 90 intakes water through the conduit 98, which is coupled to the inlet 96 via a fitting 126, such as a threaded ring. The conduit 98 also has a coupling end 128, which is configured to extend to the opening 70 (see FIG. 3). Thus, the conduit 98 extends to the inboard of the hull around the opening 70, and is sealingly coupled to the hull via a fitting 130. Furthermore, an annular ring (not shown), or any appropriate sealing element, may be used to ensure a seal at the opening.

The pump 90 expels water through a conduit 132, which is coupled to the jet 66. The conduit 132 extends through an inner passage 134 of the angular drive assembly 84, and sealingly fits into a female joint 136 in the disk-shaped head 68. Alternatively, the conduit 132 maybe coupled to the inner passage 134 at atop portion 138. In the disk-shaped head 68, an angled conduit 140 extends from the female joint 136 to the jet 66, thereby coupling the conduit 132 to the jet 66. The jet 66 may be cylindrical, as illustrated in FIG. 4, or the jet 66 may constrict the water flow toward its exit to produce the desired thrust.

The angular drive assembly 84 may include an electric drive 142 coupled to a gear assembly 144, which is coupled to a drive shaft 146 for rotating the rotatable body 64. In the illustrated embodiment of FIG. 4, the rotatable body includes disk-shaped head 68. Accordingly, the drive shaft 146 is coupled to the disk-shaped head 68 by engaging a male end 148 of the drive shaft 146 with a female joint 150 in the disk-shaped head 68. To make this connection, the drive shaft 146 is first disposed through holes 152, 154, 156 and 158 of the second plate 82, the seal 80, the mounting area 58 and the first plate 78, respectively. In operation, the drive shaft 146 rotates the disk-shaped head 68, while the angular drive assembly 84 remains fixed. Alternatively, the angular drive assembly 84 may be configured to rotate itself, along with the disk-shaped head 68 and/or the jet-drive assembly 86.

FIG. 5 illustrates a side view of an alternate embodiment of the propulsion assembly 46 disposed at the mounting area 58, wherein the hull 18 and the recessional housing 56 are illustrated as cross-sections along the longitudinal centerline of the watercraft 10. In this embodiment, the propulsion assembly 46 has a stationary housing 160 disposed about rotatable elements. The stationary housing 160 has a hollow cylindrical shape, and a plurality of holes 162 to allow water to discharge from the jet 66 (see, e.g., FIG. 6). The stationary housing 160 is fixed relative to the rotatable elements, such as by fixing the stationary housing 160 to the mounting area 58. The stationary housing 160 may be manufactured from a metal, such as aluminum. However, the stationary housing 160 may be manufactured from any other suitable metal, plastic, or durable material.

FIG. 6 illustrates a cross-sectional side view of an alternate embodiment of the propulsion assembly, wherein the stationary housing 160 is configured for mounting about the disk-shaped head 68. As illustrated, the stationary housing 160 has a cavity 164, which is cylindrically shaped to fit about the disk-shaped head 68. In operation, the disk-shaped head 68 rotates to a desired angle within the cavity 164, and the jet 66 expels water through one of the holes 162 at the desired thrust angle, for example, 0°, 45°, 90°, etc. The stationary housing 160 is secured to the mounting area 58 via fasteners, such as bolts 100. The bolts 100 are disposed through holes 166 of a flange 168, which extends around the stationary housing 160 adjacent to the first plate 78. The bolts 100 then continue through holes 102, 104, 106, 108 and into holes 110, as discussed previously and illustrated in FIG. 4.

Figure 7:
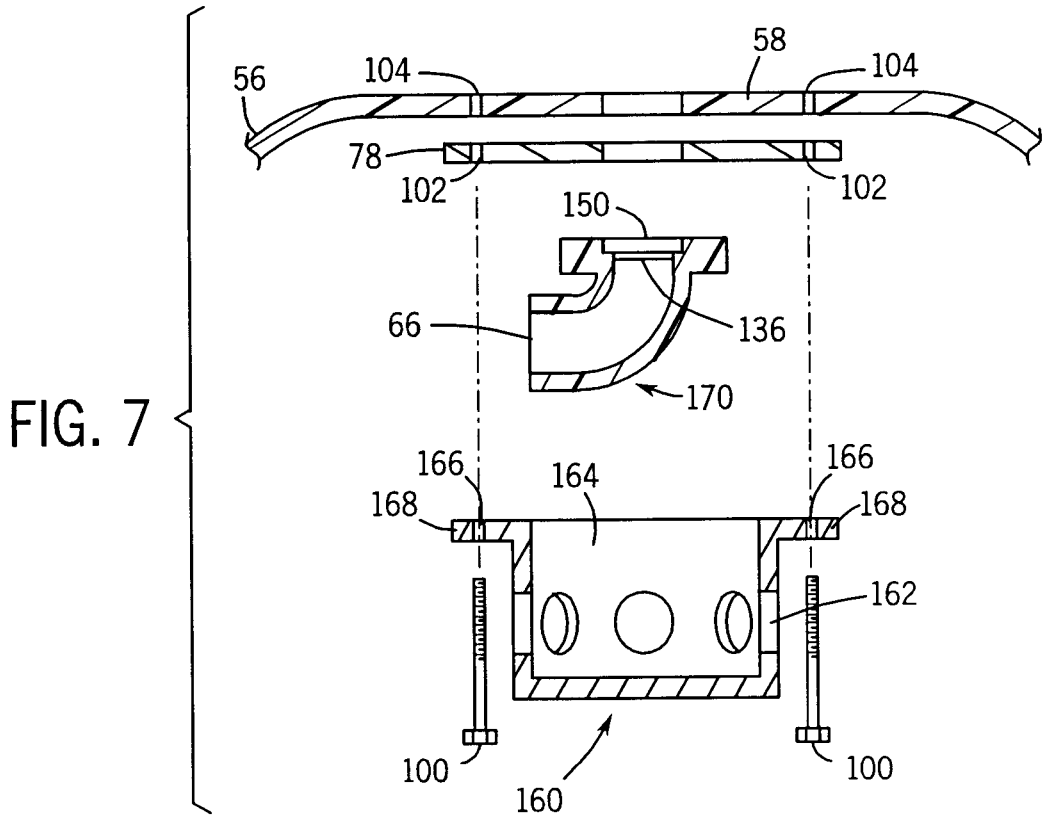
FIG. 7 is a cross-sectional side view of an alternate embodiment of the propulsion assembly, wherein the stationary housing is disposed about an angled conduit having the jet disposed thereon.

FIG. 7 illustrates a cross-sectional side view of an alternate embodiment of the propulsion assembly having the stationary housing 160. In this alternate embodiment, the rotatable body has an angled conduit 170 rather than the disk-shaped head as described above. As with the disk-shaped head, the angled conduit 170 has the female joints 136 and 150 for coupling to the conduit 132 and drive shaft 146, respectively (see, e.g., FIG. 4). Driven by the angular drive assembly 84, the drive shaft 146 rotates the angled conduit 170 to a desired angle within the stationary housing 160. The holes 162 allow the jet 66 to expel water at various angles, depending on the number and spacing of the holes 162. Alternatively, the stationary housing 160 could be eliminated.

Figure 8:
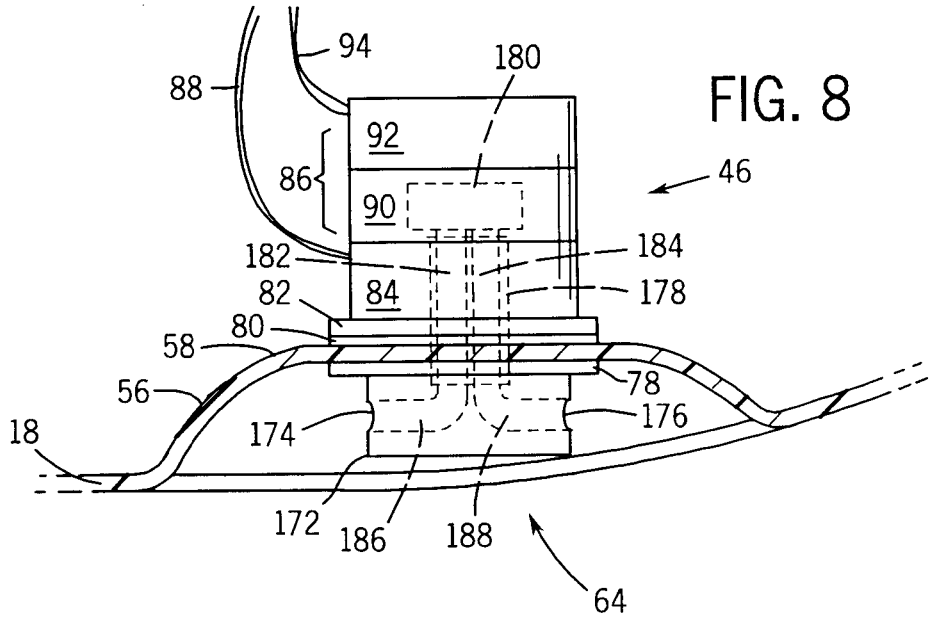
FIG. 8 is a side view of an alternate embodiment of the propulsion assembly disposed about the mounting area, wherein a disk-shaped head has two jets disposed therein.

FIG. 8 illustrates a side view of an alternate embodiment of the propulsion assembly 46 disposed at the mounting area 58, wherein the hull 18 and the recessional housing 56 are illustrated as cross-sections along the longitudinal centerline of the watercraft 10. In this alternative embodiment, the rotatable body may include the jet-drive assembly 86 and a disk-shaped head 172, which has openings 174 and 176 disposed diametrically opposite of one another in the disk-shaped head 172.

The jet-drive assembly 86 and the disk-shaped head 172 are fixedly coupled by a hollow drive shaft 178 extending from the angular drive assembly 84. In operation, the hollow drive shaft 178 is drivingly rotated by the angular drive assembly 84, which remains fixedly coupled to the mounting area 58. In this embodiment, the pump 90 has an internal pump mechanism 180, which has conduits 182 and 184 extending through the hollow drive shaft 178 and into the disk-shaped head 172. In the disk-shaped head 172, the conduits 182 and 184 are sealingly coupled to angled conduits 186 and 188, which lead to the openings 174 and 176, respectively. In this embodiment, the pump 90 intakes water through opening 176 and discharges water through opening 174. The jet-drive assembly 86 may be configured for both forward and reverse operation, thereby allowing the pump 90 to intake water through opening 174 and discharge water through opening 176.

Figure 9:
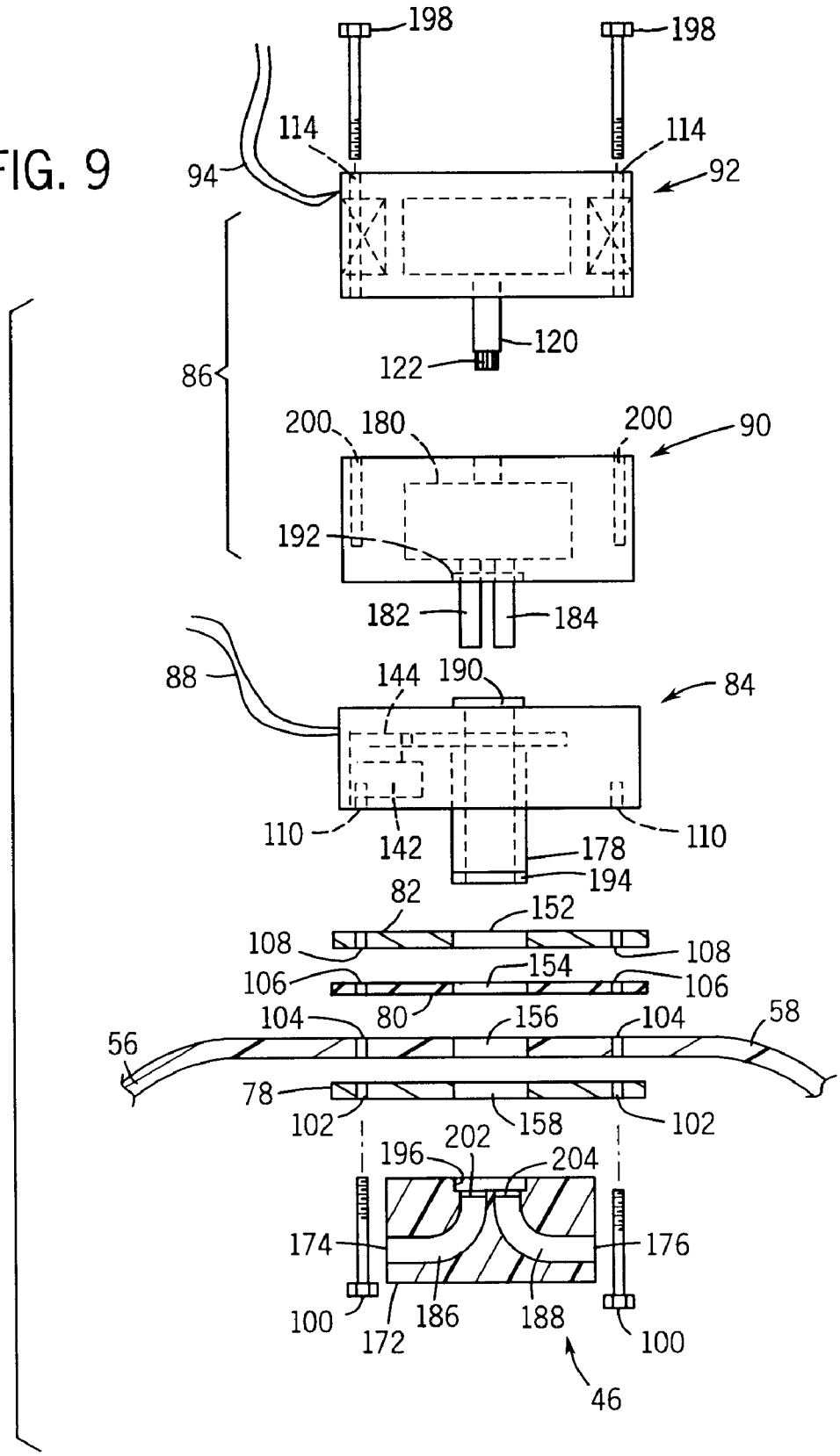
FIG. 9 is an exploded side view of an alternate embodiment of the propulsion assembly, wherein the jet-drive assembly is coupled to, and rotates with, the disk-shaped head having two jets.

FIG. 9 illustrates an exploded view of the alternate embodiment of the propulsion assembly, wherein the rotatable body may include the jet-drive assembly 86 and the disk-shaped head 172. In this embodiment, the angular drive assembly 84 is secured to the mounting area 58 via fasteners, such as bolts 100, as previously discussed. The jet-drive assembly 86 is rotatably coupled to the angular drive assembly 84 via the hollow drive shaft 178, which has a male end 190 for coupling to a female joint 192 disposed about the conduits 182 and 184 in the pump 90. Similarly, the disk-shaped head 172 is coupled to the hollow drive shaft 178 via a male end 194, which fixedly couples to a female joint 196 in the disk-shaped head 172.

In this alternative embodiment, the jet-drive assembly 86 includes the drive unit 92 and the pump 90, which are coupled by fasteners such as bolts 198. The bolts 198 are disposed into holes 114 and 200, which extend through the drive unit 92 and into the pump 90, respectively. Threads are provided in the holes 200 for securing the bolts 198. The internal mechanism 180 of the pump 90 is driven by the drive shaft 120, which extends from the drive unit 92. The internal mechanism 180 intakes water from opening 176 through the conduit 184, and expels the water through the conduit 182 and out of opening 174. The conduits 182 and 184 are sealingly disposed into female joints 202 and 204, respectively, in the disk-shaped head 172. The female joints 202 and 204 include seals to ensure a water-tight seal, for example, annular rings or any other appropriate sealing element. In the disk-shaped head 172, the angled conduits 186 and 188 extend from the female joints 202 and 204 to the openings 174 and 176, thereby coupling the conduits 182 and 184 to the openings 174 and 176.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A propulsion system for a watercraft, the watercraft having a hull and a transverse centerline, the system comprising:

a rotatable body adapted for external mounting on the hull at, or forward of, the transverse centerline of the watercraft;

a jet coupled to the rotatable body and rotatable therewith;

a jet-drive assembly coupled to the jet; and an angular drive assembly coupled to the rotatable body, wherein the angular drive assembly comprises an electric motor configured for orienting the jet to produce a thrust in a desired direction during operation.

2. The propulsion system of claim 1, wherein the rotatable body is substantially disk-shaped.

3. The propulsion system of claim 1, wherein the rotatable body comprises an angled conduit.

4. The propulsion system of claim 1, further comprising a stationary housing having at least the jet disposed therein, and the stationary housing having at least one opening configured to permit the jet to expel water during operation.

5. The propulsion system of claim 4, comprising a plurality of openings extending between an external surface and an inner cavity of the stationary housing in which the jet is disposed.

6. The propulsion system of claim 1, further comprising a first conduit coupling the jet-drive assembly to the jet, and a second conduit configured for coupling the jet-drive assembly to an opening in the hull to intake water.

7. The propulsion system of claim 1, wherein the jet-drive assembly comprises a drive assembly coupled to a pump assembly.

8. The propulsion system of claim 7, wherein the drive assembly comprises an electric drive motor.

9. The propulsion system of claim 7, wherein the pump assembly comprises a rotary pump.

10. The propulsion system of claim 7, wherein the pump assembly is coupled to, and is rotatable with, the rotatable body.

11. The propulsion system of claim 7, wherein the drive assembly is coupled to, and is rotatable with, the rotatable body.

12. The propulsion system of claim 1, wherein the jet-drive assembly is configured for inboard mounting.

13. The propulsion system of claim 1, wherein the angular drive assembly is configured to rotate the rotatable body to an angle within an operable range relative to the transverse centerline.

14. The propulsion system of claims 13, wherein the operable range includes angles from 0° to 360° with respect to the transverse centerline.

15. The propulsion system of claim 13, wherein the operable range includes angles from 0° to 180° with respect to the transverse centerline.

16. The propulsion system of claim 1, further comprising at least one steering member adapted to couple the angular drive assembly to the rotatable body.

17. The propulsion system of claim 16, wherein the steering member comprises a hollow shaft.

18. The propulsion system of claim 1, further comprising a recessional mounting panel configured for fixed external mounting on the hull at, or forward of, the transverse centerline, and adapted for mounting the rotatable body.

19. A watercraft comprising:

a rotatable body mounted to a hull of the watercraft at, or forward of, a transverse centerline of the watercraft;

a recessional mount disposed on the hull at, or forward of, the transverse centerline for mounting the rotatable body;

a jet coupled to the rotatable body and rotatable therewith;

a pump assembly coupled to the jet;

a drive assembly coupled to the pump assembly; and an angular drive assembly coupled to the rotatable body configured for orienting the jet to produce a thrust in a desired direction during operation.

20. The watercraft of claim 19, wherein the rotatable body is substantially disk-shaped.

21. The watercraft of claim 19, wherein the rotatable body comprises an angled conduit.

22. The watercraft of claim 19, further comprising a stationary housing having at least the jet disposed therein, and the stationary housing having at least one opening configured to permit the jet to expel water during operation.

23. The watercraft of claim 22, comprising a plurality of openings extending between an external surface and an inner cavity of the stationary housing in which the jet is disposed.

24. The watercraft of claim 19, further comprising a first conduit coupling the pump assembly to the jet, and a second conduit coupling the pump assembly to an opening in the hull for intaking water.

25. The watercraft of claim 19, wherein the drive assembly comprises an electric drive motor.

26. The watercraft of claim 19, wherein the drive assembly and the pump assembly are reversible for reversing the flow of water.

27. The watercraft of claim 19, wherein the drive assembly and the pump assembly are mounted inboard.

28. The watercraft of claim 19, wherein the angular drive assembly is configured to rotate the rotatable body to an angle within an operable range relative to the transverse centerline.

29. The propulsion system of claim 19, wherein the angular drive assembly comprises an electric motor.

30. The watercraft of claim 19, wherein the angular drive assembly is configured to rotate with the rotatable body.

31. The watercraft of claim 19, wherein the angular drive assembly is fixed relative to the rotatable body.

32. The watercraft of claim 19, wherein the rotatable body is mounted along a longitudinal centerline of the watercraft.

33. A technique for watercraft propulsion comprising:

fixedly mounting a rotatable propulsion assembly to a hull of a watercraft at, or forward of, a transverse centerline of the watercraft, the rotatable propulsion assembly having a steering assembly, a jet coupled to the steering assembly, and a pump assembly coupled to the jet; and driving the pump to expel water from the jet to produce a desired thrust; and fixedly coupling a recessional mount to the hull at, or forward of, the transverse centerline for mounting the rotatable propulsion assembly.

34. The technique of claim 33, further comprising rotating a portion of the propulsion to direct the desired thrust.

* * * * *